US008708598B2

(12) United States Patent
Hanson et al.

(10) Patent No.: US 8,708,598 B2
(45) Date of Patent: Apr. 29, 2014

(54) STROKE CONTROL TROWEL

(71) Applicants: Steven K. Hanson, Wampa, ID (US); Cole R. Baird, Caldwell, ID (US); Robert Dane Davis, Boise, ID (US); Benjamin A. Wiese, Nampa, ID (US); Brian L. Hammond, Kuna, ID (US); David Lilienthal, Brookings, OR (US); Bruce Gillespie, Lake Oswego, OR (US)

(72) Inventors: Steven K. Hanson, Wampa, ID (US); Cole R. Baird, Caldwell, ID (US); Robert Dane Davis, Boise, ID (US); Benjamin A. Wiese, Nampa, ID (US); Brian L. Hammond, Kuna, ID (US); David Lilienthal, Brookings, OR (US); Bruce Gillespie, Lake Oswego, OR (US)

(73) Assignee: Multiquip, Inc., Carson, CA (US)

( * ) Notice: Subject to any disclaimer, the term of this patent is extended or adjusted under 35 U.S.C. 154(b) by 0 days.

(21) Appl. No.: 13/676,880

(22) Filed: Nov. 14, 2012

(65) Prior Publication Data

US 2013/0315667 A1 Nov. 28, 2013

Related U.S. Application Data

(60) Provisional application No. 61/561,551, filed on Nov. 18, 2011.

(51) Int. Cl.
*E04F 21/24* (2006.01)
*E01C 19/22* (2006.01)

(52) U.S. Cl.
USPC ..... 404/84.1; 404/112

(58) Field of Classification Search
USPC ..... 404/84.1, 112; 701/42, 50
IPC ..... E01C 19/22,19/30; E04F 21/24
See application file for complete search history.

(56) References Cited

U.S. PATENT DOCUMENTS

| | | | | |
|---|---|---|---|---|
| 5,584,598 | A * | 12/1996 | Watanabe et al. | 404/112 |
| 5,816,739 | A * | 10/1998 | Allen | 404/112 |
| 5,890,833 | A * | 4/1999 | Allen et al. | 404/112 |
| 6,106,193 | A * | 8/2000 | Allen et al. | 404/112 |
| 8,388,264 | B2 | 3/2013 | Grahl | |
| 2013/0129419 | A1 * | 5/2013 | Hanson et al. | 404/112 |

* cited by examiner

*Primary Examiner* — Gary Hartmann
(74) *Attorney, Agent, or Firm* — Frank J. Dykas; Dykas & Shaver

(57) ABSTRACT

An automatic speed control system for a power trowel for regulated adjustment of rotational speed of the trowel rotor assemblies. The disclosure provides for and is configurable to automatically regulate trowel speed and can be adapted to utilize advanced control features like cruise control and power management. The disclosed system incorporates several user and feedback inputs in a number of logic patterns for trowel control.

34 Claims, 7 Drawing Sheets

STROKE CONTROL TROWEL

PRIORITY/CROSS-REFERENCE TO RELATED APPLICATIONS

This application claims the benefit of U.S. Provisional Application No. 61/561,551, filed Nov. 18, 2011, the disclosure of which is incorporated herein by reference.

TECHNICAL FIELD

The present disclosure relates to speed control for hydraulically steered, riding power trowels.

BACKGROUND

The process of finishing concrete through the concrete curing phases with a self-propelled power trowel is ever changing. Riding power trowels are used for finishing concrete surfaces as the concrete is curing and hardening. A typical riding power trowel is a two-rotor device, with each rotor having a plurality of troweling blades extending out in radial fashion, and usually configured such that the working edge of each blade is in a plane perpendicular normal to the axis of rotation to provide for smooth and flat finishing of the concrete surface below the riding trowel. There is provided a rigid frame that houses the rotor assemblies, and also an engine, usually a gasoline or diesel engine, which provides the motive power for the rotor assemblies and thus the trowel blades. Atop of the engine and the frame assembly is found an operator's seat and the necessary control systems and levers for operation of the machine. These machines are manufactured in a variety of sizes and weights, with the largest of these machines having not just two, but rather three, rotor and troweling blade assemblies.

For purposes of this prior art section and the entire specification, a two-rotor machine will be used as an example. In two-rotor machines, both rotor assemblies rotate in opposite directions, one to the other. This is shown in FIG. 1.

In FIG. 1, there is shown a two-rotor assembly, wherein each rotor assembly has a gear box, hydraulic drive motor or other means of driving rotation, and troweling blade assemblies that rotate around respective axes of rotation, identified as $A_{RL}$ for the axis of rotation for the left rotor, and $A_{RR}$ as the axis of rotation for the right rotor assembly. Early versions of riding power trowels were mechanically steered. That is, the riding operator manipulated levers that were mechanically connected to the rotors to steer the trowel. But more recent riding trowels utilize hydraulic steering.

As shown in prior art FIG. 2, the hydraulically controlled steering power trowel is formed of the same basic sub-assemblies, including a rigid frame, engine assembly, operator seat and manual trowel blade pitch control systems, all of which are well known in the art. Also included are left control post and right control post that house, respectively, a left control valve assembly and a right control valve assembly. In a typical device, both the left and right control valve assemblies are proportional pressure output hydraulic valves capable of delivering and maintaining a selectable pressure to a dual-action hydraulic cylinder. It should be understood that designations "left" and "right," as used here, are arbitrary; and the functions of what are designated in this disclosure as the "left" and "right" may be accomplished, at the designer's preference, by applying the operable principles to any riding trowel regardless of which of the several assemblies is designated "left" or "right.".

The left control valve assembly is operably interconnected between the frame of the power trowel and the left rotor assembly, and is used to adjust the tilt of the left rotor assembly either inwardly toward the center line of the frame, or outwardly away from the center line of the frame. The left control valve assembly is a single-action proportional pressure output valve that is operable to maintain a selectable hydraulic pressure within one or the other sides of the left dual-action hydraulic cylinder and is operably connected to the left rotor assembly to provide a tilting, either in or out from the center line movement for the left rotor assembly. Hydraulic power is provided by a standard hydraulic pump that is operably connected to the trowel engine.

Again, only one rotor assembly, which in this example is the left rotor assembly, is only tiltable in and out from the center line. This is achieved by use of a universal drive assembly that is provided to interconnect the output drive shaft of the engine assembly to the rotor assembly. The universal drive assembly is capable of allowing the tilt motion for the left rotor either in or out relative to the center line of the power trowel.

Likewise, the right rotor assembly is interconnected by means of a dual-action universal assembly to the output drive assembly of the engine, and is therefore tiltable not only in an in-and-out direction relative to the center line, but it is also capable of being tilted either in a forward or aft direction. The right rotor assembly is provided with a right lever tilt post and a right forward and aft tilt post. Attached to the right lever tilt post is a dual action right tilt cylinder that is interconnected between the frame and the right tilt lever. In a similar manner, a second dual-action cylinder, the right forward and aft tilt cylinder, is interconnected to the right forward and aft tilt post and is anchored to the frame. The right control valve assembly is a dual action control system, and is operable to maintain a selectable hydraulic pressure in either side of both the right tilt cylinder and the right forward and aft cylinder, thus controlling not only the tilt of the right rotor assembly, but also its forward and aft movement.

Both left and right control valve assemblies are fitted with joysticks that are configured such that if they are pushed forward, both rotor assemblies will tilt inwardly to move the power trowel forward, and conversely, if tilted backward toward the operator, they will operate to tilt the rotors outwardly to move the machine backward. The guidance system just described was fully disclosed in the Applicant's '740 Patent. What the prior art lacks, however, is a means for regulated adjustment of rotational speed of the rotor assemblies.

SUMMARY OF DISCLOSURE

The disclosed device is a speed control system for a power trowel that is configured to have regulated adjustment of rotational speed of the rotor assemblies. In this way, the power output of the trowel can be automatically regulated and can be adapted to utilize advanced control features such as cruise control and power management.

The power trowel for which the speed control system is designed includes, at a minimum, a power transfer unit, which is typically in the form of a hydraulic pump but could take other embodiments. The power trowel, on which the speed control system is incorporated, also includes, at a minimum, a pair of rotor assemblies that contact the concrete surface and support the frame and the power plant on the concrete surface. The rotor assemblies are attached to the frame and configured to tilt in order to provide direction control for the power trowel. The rotor assemblies include a number of trowel blade assemblies with attached trowel blades, with trowel blades configured for adjustable pitch.

The power trowel includes, at a minimum, a first user input device for pitch control of the trowel blades. The second user input device controls the tilt control of the rotor assemblies. The third user input device is for control of the speed of rotation of the trowel blades and provides what is referred to throughout this disclosure as the user command or reference signal. This third user input device would typically be a pedal, but could also be a joystick or a shift knob or dial or a digital screen with digital control. The third user input generates a desired speed signal—i.e. a user command or reference input—indicative of the trowel user's desired rotational speed of the rotor assemblies.

In the hydraulic motor version of the device, the user command changes the pump displacement and thus changes the speed of rotation of the rotor assemblies. The disclosed device includes, at a minimum, a first sensor that measures blade speed. The measurement of blade speed can be a direct measurement of the angular speed of the rotating blades, or it can be measured indirectly by sensing the pump stroke or pump displacement or the hydraulic motor's revolutions per minute (RPM). In the preferred embodiment and best mode presently known, pump stroke is measured to determine blade speed. The first sensor generates a speed feedback signal that is sent to a logic controller with the feedback signal indicative of the speed of rotation of the rotor assemblies. The disclosed speed control device includes, at a minimum, a logic controller for controlling the speed of rotation of the trowel blades by changing either the engine RPM or the displacement of the pump. The logic controller accomplishes this by sending a control signal to the power plant or the pump displacement controls. In the preferred embodiment, the logic controller changes the displacement of the hydraulic pump, which adjusts the rotational speed of the rotor assemblies.

The logic controller contains one or more logic patterns for correlating the reference input signal, engine load signal, and speed feedback signal with the control signal. The primary logic pattern that is in the logic controller is the "follower logic pattern." The follower logic pattern takes a reference input signal from the operator or other logic patterns and a speed feedback signal, from which two signals the logic controller generates a control signal that is continually adjusted so that the difference between the speed feedback and reference input signals are minimized.

To clarify, the signals in the follower logic pattern include:

(1) The reference input signal, which is from the operator and may be scaled by various user controls, and is used to input a desired rotor assembly rotational speed;

(2) The speed feedback signal, which is from the rotor assembly or assemblies and is used as a feedback means to adjust the control signal, and which can be a first speed feedback signal and a second speed feedback signal if the rotor assemblies are independently controlled; and (3) The control signal from the logic controller, used to control rotor assemblies rotational speed, which can be a first control signal and a second control signal if the rotor assemblies are independently controlled.

Another logic pattern is the "cruise control" or "cruise function" logic pattern. This logic pattern may be activated by a cruise control switch or activation button. When the cruise control logic pattern is activated, the reference input signal is logic at the value recorded at the moment the cruise control switch was activated. This locked reference input signal is then used by the logic controller and other logic patterns to generate a control signal.

Another logic pattern is a "power management" logic pattern. The power management logic pattern takes a load feedback signal and scales the reference input signal to generate a scaled reference input signal. Scaling the control signal adjusts the rotor assemblies' rotational speed, thereby reducing the power requirements from the power plant and preventing overloading. This scaled reference input signal is then used by the logic controller and other logic patterns to generate a control signal. The cruise control and power management logic patterns may be used in combination with the follower logic pattern, whereby the cruise control locks in, and power management scales the reference input signal.

Another logic pattern is the matching logic pattern. The matching logic pattern takes compares feedback signals from each rotor assembly and adjusts the respective control signal such that the control signal for each rotor assembly matches the other.

Although the hydraulic pump disclosed here would typically be a variable displacement pump, the speed control system and each of the logic patterns would also function with a fixed displacement pump and variable displacement motors.

EMBODIMENTS OF PRESENT DISCLOSURE

Figure 1:
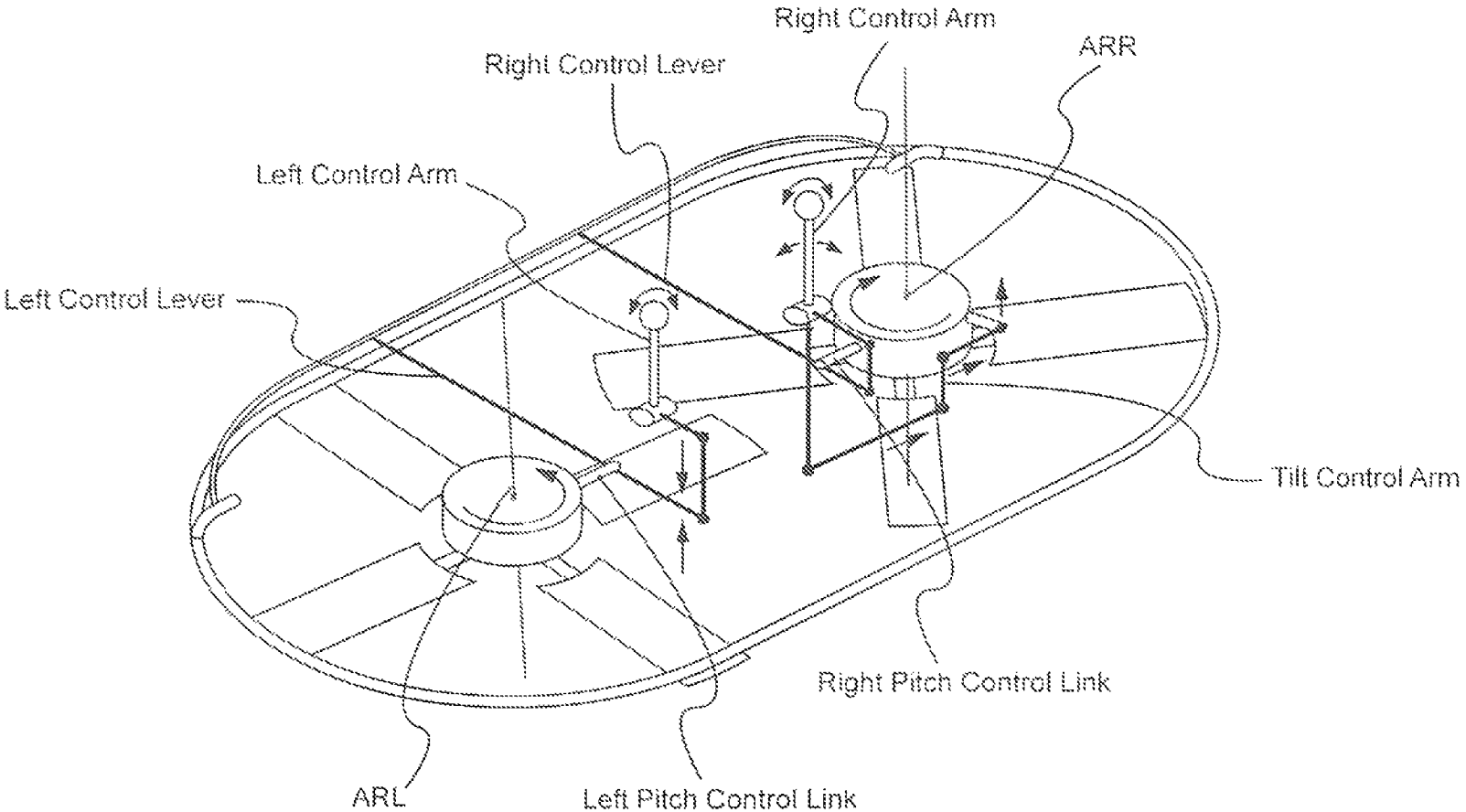
PRIOR ART Fig. 1
FIG. 1 is a prior art schematic representation of a mechanical control system of a two-rotor power trowel.
Figure 2:
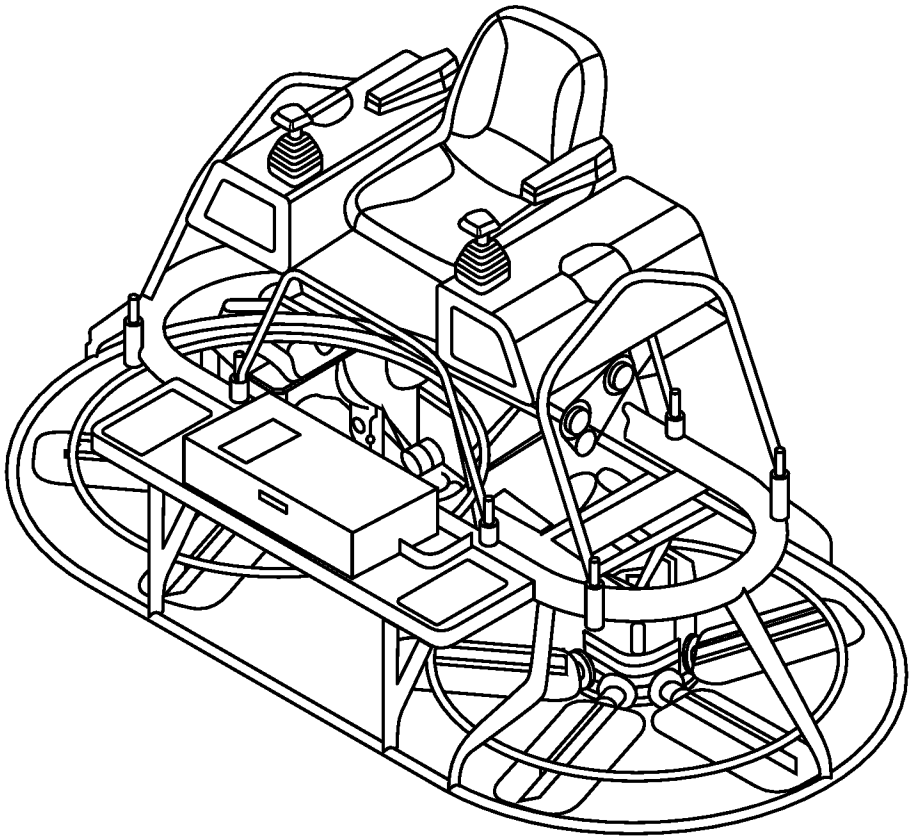
PRIOR ART Fig. 2
FIG. 2 is a perspective representational drawing of a prior art hydraulically controlled riding power trowel.
Figure 3:
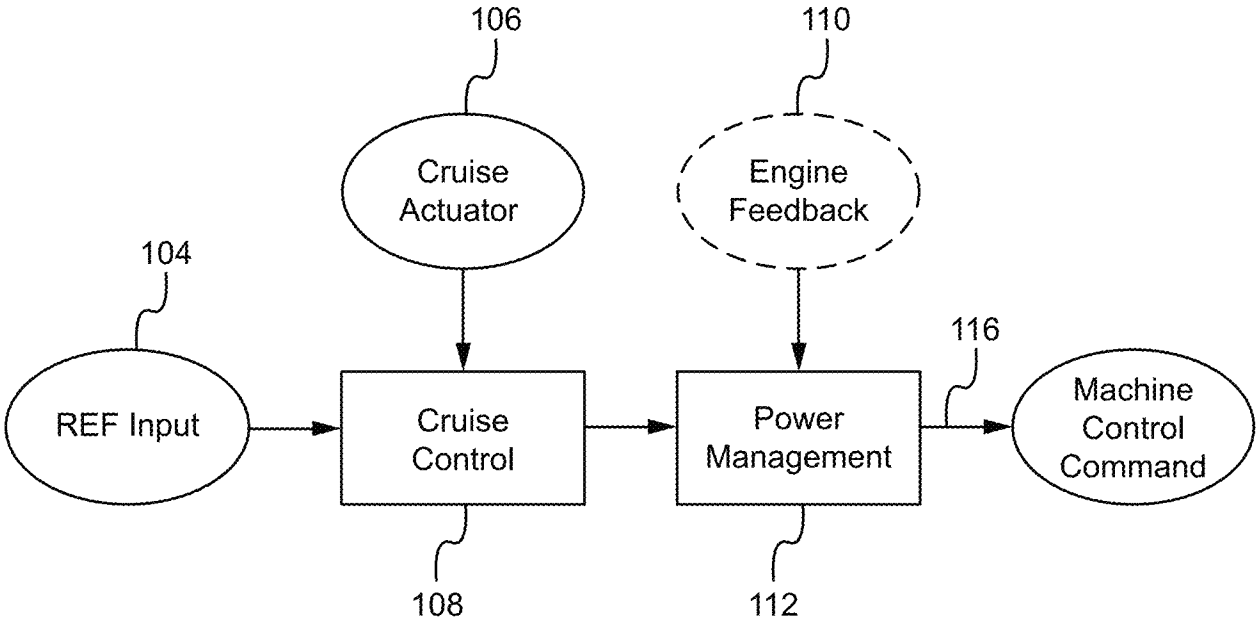
FIG. 3 depicts an embodiment of the disclosure wherein the trowel is equipped with direct speed control.

The disclosure may be implemented in a number of ways, depending on the preference of the designer and user. In one embodiment, depicted in FIG. 3, the trowel is equipped with direct control, via a reference input signal 104. The reference input signal is generated by a user input device (referred to above as a third input device), which allows the user to control the trowel speed in real time, much like an automobile driver controls speed with an accelerator pedal. This input device could be a foot pedal, a dial, a thumb wheel, a joystick, or other input device, and communicated to the rotor assemblies by way of hydraulic cylinders, servo valves/electric-over-hydraulic cylinders, or direct mechanical linkage.

In this or other embodiments, there could be provided a cruise control 108 (aka, cruise function) or a power management function, or both. When the cruise actuator 106 is engaged, the cruise control utilizes an electric or mechanical device for locking or maintaining the reference input signal 104. The cruise actuator comprises a means for engaging and disengaging the cruise control. The cruise actuator could be a switch, level, toggle, push button, control screen setting, other user interface.

The power management function (aka power management logic) 112 utilizes load or engine feedback 110 from the trowel engine by monitoring the load of the rotor assemblies or the trowel engine, or both, utilizing a sensor or meter, or combination of sensors or meters. Further, the power management function relies on control logic to proportionally adjust the reference input to reduce machine loading as necessary to safely and efficiently operate the trowel. The reference input may thus be scaled by the power management function to create a scaled reference signal 116, which, in this embodiment, is equivalent to the control signal (118).

The trowel may also be equipped with control logic that incorporates other feedback signals in other respects. Embodiments such as that depicted in FIG. 4, rely on a speed feedback signal 220, which may include a signal relating the position of the rotor assemblies with respect to some predetermined reference point, as measured by displacement or physical position of hydraulic cylinders; or it could include the rotor speed, as determined by a tachometer, or other angular speed-measuring device, on the rotor assembly; or it could include a signal relating the hydraulic fluid flow rate of fluid in and to the rotor assemblies, as measured by a flowmeter integrated into the rotor assemblies; or the feedback signal could comprise all or any of these. Furthermore, the trowel's engine is monitored via signals representing engine RPM, percentage engine load, and the trowel's fuel delivery system. Such signals may come from any appropriate measuring device, including one or more tachometer, flowmeter, thermometer, and pressure meter.

Figure 4:
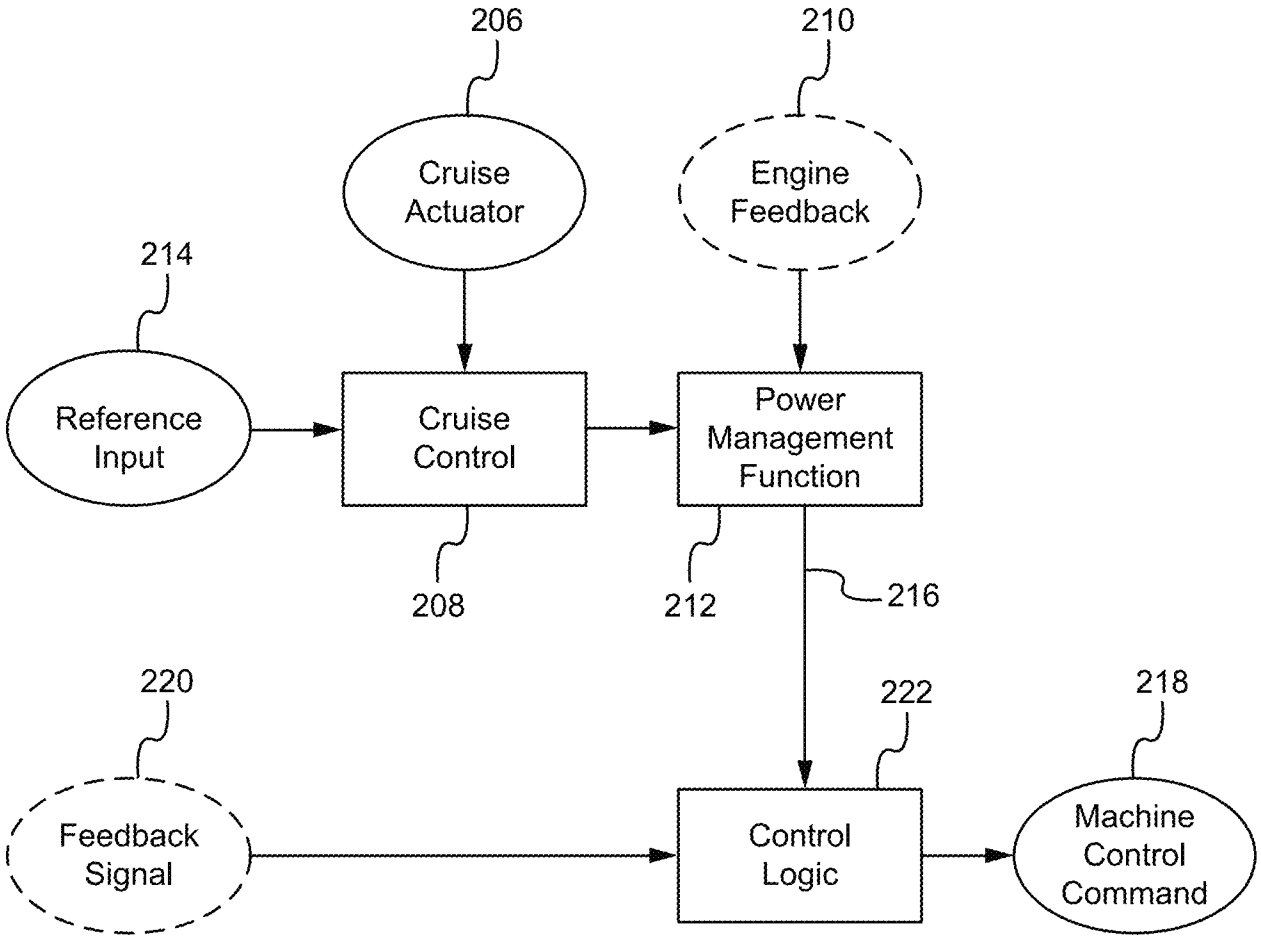
FIG. 4 depicts an embodiment of the disclosure wherein the trowel is equipped with feedback speed control.

In an embodiment that incorporates signal control with feedback—like the embodiment shown in FIG. 4—there is provided a control logic 222 that processes a reference input signal 214, or scaled reference input 216, and speed feedback signal 220 as inputs and outputs a control signal 218 to the engine to ensure that the engine or rotor assemblies, or both, are not operated beyond tolerable limits, and that power to both rotor assemblies is equal.

Figure 5:
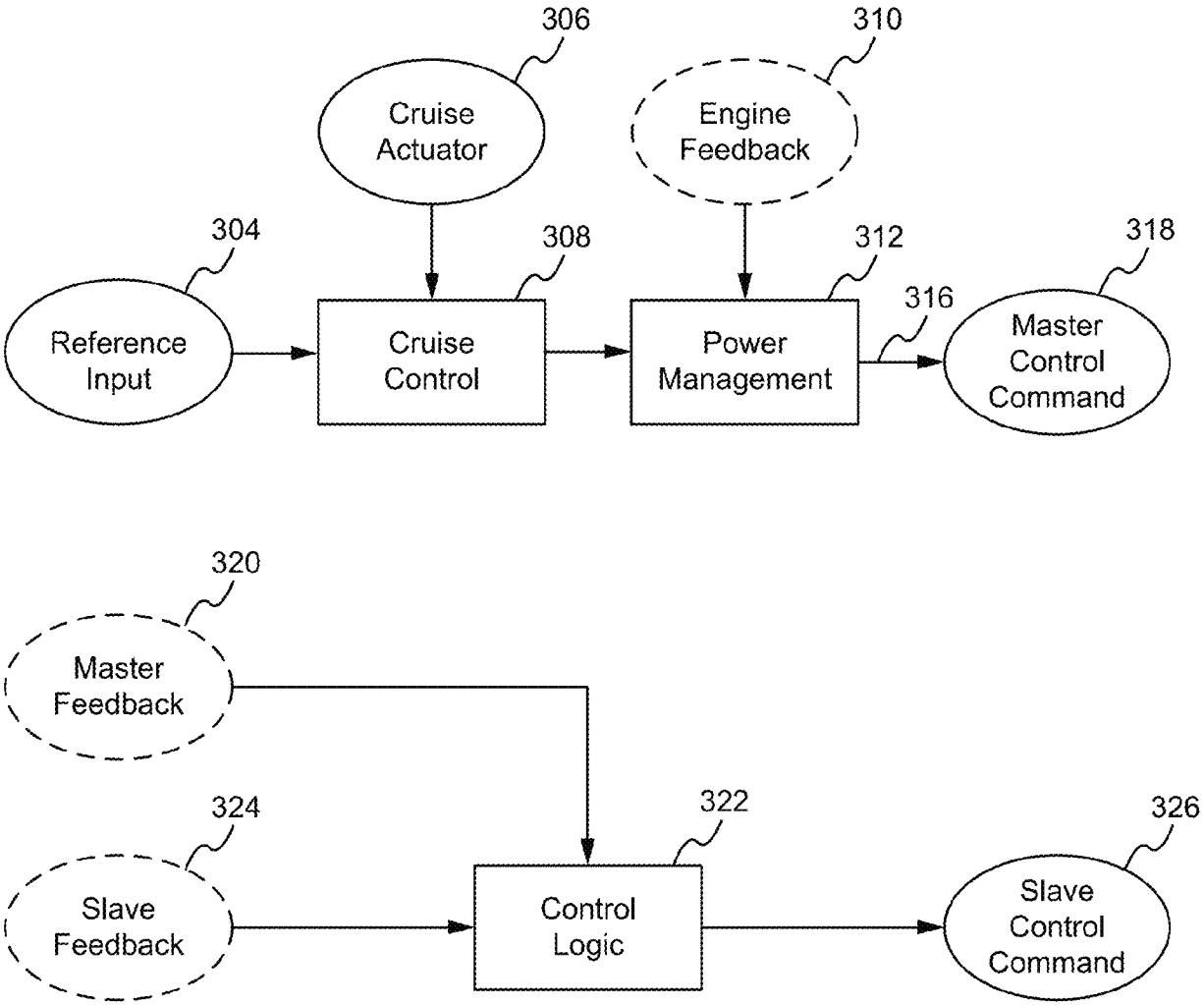
FIG. 5 depicts an embodiment of the disclosure wherein the trowel is equipped with master-slave, with feedback, speed control.

In another embodiment, shown in FIG. 5, there is provided a control system that utilizes master-slave (aka, mother-daughter) control based on feedback, wherein the master control relies on a direct input from the user, while the slave control relies on feedback. In this embodiment, there is direct control via reference input signal 304, as described above, for control of pump displacement or engine speed of one rotor assembly, designated the "master" rotor assembly or assemblies. In other words, the master rotor assembly receives a control signal 318 equal to the reference input 314, or scaled reference input 316, signal. There is also provided a control logic 322 that accepts a speed feedback signal 320, of the type described above, from the master rotor assembly. In this embodiment, the speed feedback signal from the master rotor assembly is processed as a reference input signal in follower logic pattern of the control logic 322. The control logic 322 accepts a speed feedback signal (324) from the other, "slave," rotor assembly or assemblies, and outputs a control signal (326) to the slave rotor assembly. The control logic 322 utilizes a matching logic pattern to ensure that the slave rotor assembly is operating under power equal that of the master.

Figure 6:
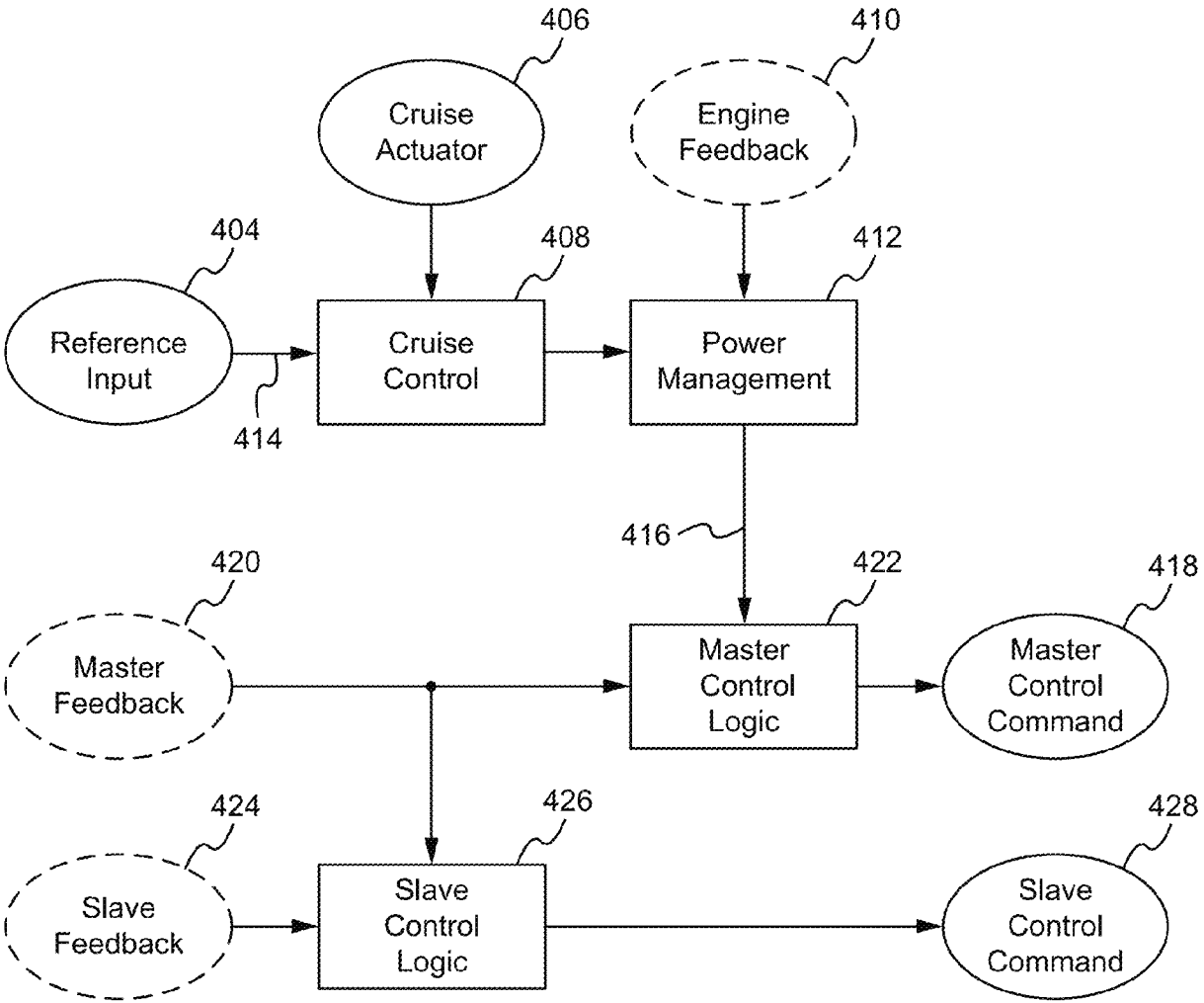
FIG. 6 depicts an embodiment of the disclosure wherein the trowel is equipped with dual logic, master-slave, with feedback, speed control.

In another embodiment, shown in FIG. 6, there is provided a control system that utilizes master-slave control, wherein both master and slave rely on speed feedback. In this embodiment, there is provided a control unit with two logic steps 422 and 426. The first control logic step 422 accepts a reference input signal 404, which may be scaled by power management function 412 to create a scaled reference input 416, and a speed feedback signal 420 from one rotor assembly, designated the master. The first control logic step 422 outputs a control signal 418 to the master rotor assembly. The second control logic step 426 accepts a speed feedback signal 420 from the master rotor assembly, which functions as a reference input signal for the second control logic 426, and the second control logic also accepts a feedback signal 424 from the slave rotor assembly. The second control logic step 426 outputs a control signal 428 to the slave rotor assembly. The first control logic 422 ensures that reference 414 or scaled reference 416 input and feedback from the master rotor assembly are equal; and the second control logic 426 ensures that the feedback 420 from the master rotor assembly and feedback 424 from the slave rotor assembly are equal. In this way, the control system ensures that the master and slave are operating under equal power.

Figure 7:
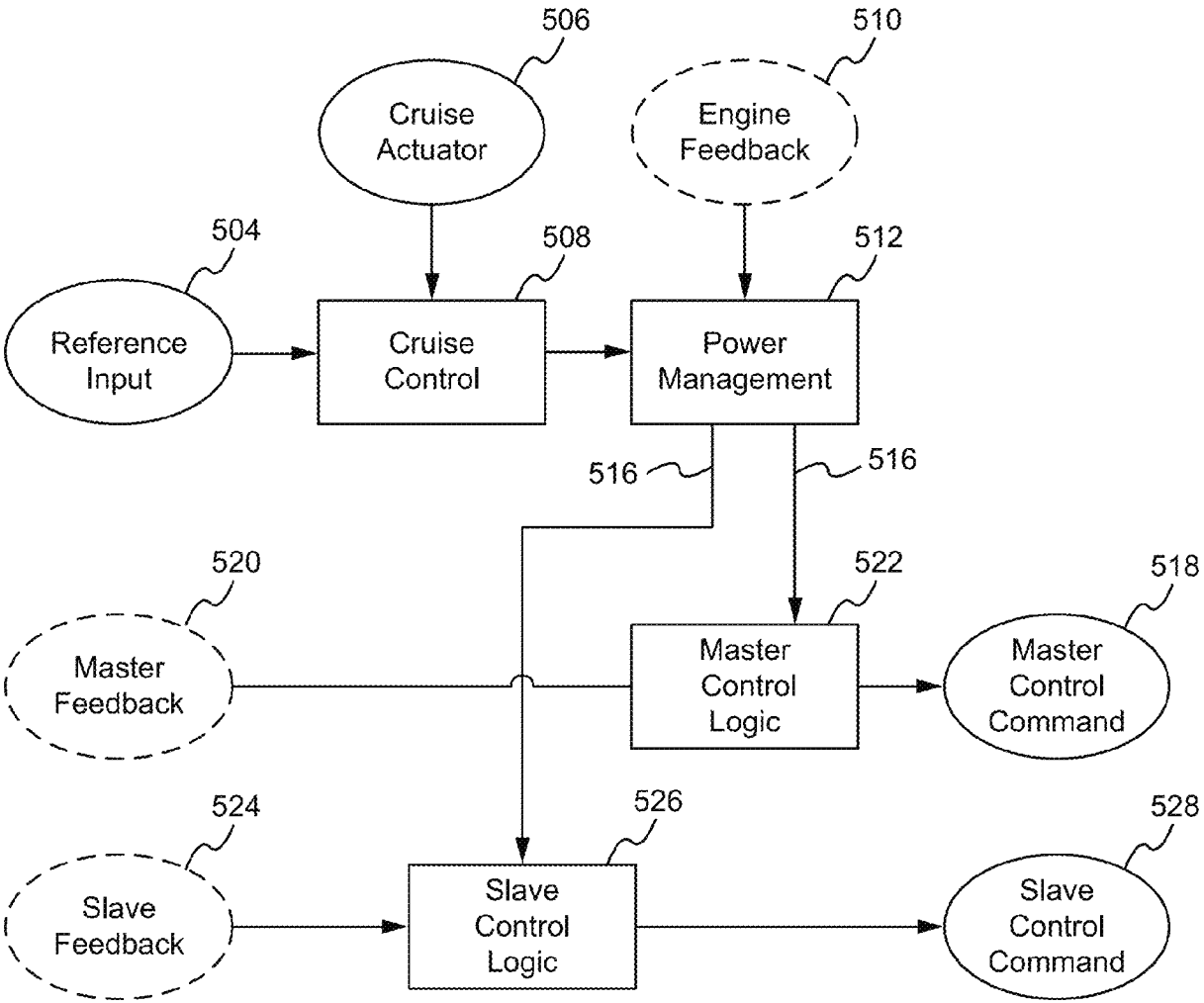
FIG. 7 depicts an embodiment of the disclosure wherein the trowel is equipped with dual logic, single reference, with feedback, speed control.

In another embodiment, shown in FIG. 7, there is provided a control system that controls both rotor assemblies individually, relying on speed feedback. In this embodiment, there is provided separate control logic for each of the master rotor assembly and the slave rotor assemblies. Both the master 522 and slave 526 control logic accept a reference input signal 504, which may be scaled by power management function 512 to become a scaled reference input 516. In both master 522 and slave 526 control logic, this is processed as a reference input. The master control logic 522 also accepts a speed feedback signal 520 from the master rotor assembly. The master control logic outputs a master control signal 518 to the master rotor assembly. The slave control logic 526 also accepts a speed feedback signal 524 from the slave rotor assembly. The slave control logic 526 outputs a slave control signal 528 to the slave rotor assembly. Both master and slave control logic ensure that the reference input signal or scaled reference input signal is equal to the respective feedback input signal to maintain equal operating power for each rotor assembly.

In addition to the example given above, it is contemplated that sensors/meters for creating signals can include dynomometers, RPM sensors, tachometers, strain gauges, potentiometers, linear position sensors, and transducers. Any combination of these sensors/meters could be implemented to monitor and provide the input or feedback signals, or both, which are described above.

One way this system would work is that it would act as a gear reduction strategy when a trowel is placed on wet concrete. At that time the motor tends to lug down, and stroke control would allow a gear down effect to help the motor out, and could even allow a smaller motor to be used for a particular job. This would provide a sort of continuously variable transmission based on hydraulic power, and could be analogous with mechanic devices which provide for mechanical adjustment of gear ratios.

What is claimed is:

1. A speed control system for a self-propelled power trowel for finishing a concrete surface, said power trowel comprising:

a rigid frame means adapted to be disposed over said concrete surface, said rigid frame means having a front and a rear and defining a centerline from front to rear;

power means for powering said power trowel supported by the frame means;

a pair of rotor assemblies for frictionally contacting said concrete surface and supporting said frame means on said concrete surface, connected to the frame means so as to allow tilting of said rotor assemblies and operably connected to the power means, with each of said rotor assemblies comprising a plurality of troweling blade assemblies with said speed control system comprising:

a user input for generating a reference input signal for controlling rotation speed of said rotor assemblies;

a speed feedback signal proportional to rotational speed of said rotor assemblies; computing means which comprises a follower logic pattern that compares the reference input signal and speed feedback signal of said rotor assemblies, and adjusts a control signal to minimize the difference between the feedback and reference input signal, with the control signal changing the speed of rotation of said rotor assemblies.

2. The speed control system of claim 1 with a cruise control actuator which activates a cruise control logic pattern that keeps the reference input signal into a matching logic pattern at the same level as it is the moment the cruise control actuator is activated.

3. The speed control system of claim 1 with power management logic pattern that takes a load feedback signal and scales the reference input signal to generate a scaled reference input signal into the matching logic pattern.

4. The speed control system of claim 1 in which said speed feedback signal is generated by a blade speed sensor.

5. The speed control system of claim 1 in which said speed feedback signal is generated by an RPM feedback unit on the power transfer means of said rotor assemblies.

6. The speed control system of claim 1 in which the said feedback signal is generated by a sensor measuring the displacement of a hydraulic pump, with the hydraulic pump operatively connecting the power means and the rotor assemblies.

7. The speed control system of claim 1 which further comprises one or more hydraulic pumps, each with controllable variable displacement, with each hydraulic pump having a control system with a transducer which generates a said speed feedback signal.

8. The speed control system of claim 1 which further comprises one or more hydraulic pumps, each with controllable variable displacement, with each hydraulic pump being controlled by a single control system with a transducer which generates a said speed feedback signal.

9. A speed control system for a self-propelled power trowel for finishing a concrete surface, said power trowel comprising:

a rigid frame means adapted to be disposed over said concrete surface, said rigid frame means having a front and a rear and defining a centerline from front to rear;

power means for powering said power trowel supported by the frame means;

a pair of rotor assemblies for frictionally contacting said concrete surface and supporting said frame means on said concrete surface, connected to the frame means so as to allow tilting of said rotor assemblies and operably connected to the power means, with each of said rotor assemblies comprising a plurality of troweling blade assemblies;

with said speed control system comprising:

a user input for generating a reference input signal for controlling rotation speed of said rotor assemblies;

a first speed feedback signal proportional to rotational speed of first said rotor assembly;

a second speed feedback signal proportional to rotational speed of second said rotor assembly;

computing means which comprises a first and second follower logic pattern;

the first follower logic pattern compares the reference input signal and first speed feedback signal of said first rotor assembly, and adjusts a first control signal to minimize the difference between the first speed feedback signal and reference input signal, with the first control signal changing the speed of rotation of first said rotor assemblies; and the second follower logic pattern compares the reference input signal and second speed feedback signal of said second rotor assembly, and adjusts the second control signal to minimize the difference between the second speed feedback signal and reference input signal, with the control signal changing the speed of rotation of second said rotor assemblies.

10. The speed control system of claim 9 with a cruise control actuator which activates said cruise control logic pattern that keeps the reference input signal into the matching logic pattern at the same level as it is the moment the cruise control actuator is activated.

11. The speed control system of claim 9 with power management logic pattern that takes a load feedback signal and scales the reference input signal to generate a scaled reference input signal into the follower logic pattern.

12. The speed control system of claim 9 in which said speed feedback signals are generated by blade speed sensors.

13. The speed control system of claim 9 in which said speed feedback signals are generated by RPM feedback units on the power transfer means of said rotor assemblies.

14. The speed control system of claim 9 in which the said feedback signals are generated by sensors measuring the displacement of the hydraulic pumps, with the first hydraulic pump operatively connecting the power means and the first rotor assembly and the second hydraulic pump operatively connecting the power means and the second rotor assembly.

15. The speed control system of claim 9 which further comprises two or more hydraulic pumps, each with controllable variable displacement, with each hydraulic pump having a control system with a transducer which generates a said speed feedback signal.

16. A speed control system for a self-propelled power trowel for finishing a concrete surface, said power trowel comprising:

a rigid frame means adapted to be disposed over said concrete surface, said rigid frame means having a front and a rear and defining a centerline from front to rear;

power means for powering said power trowel supported by the frame means;

a pair of rotor assemblies for frictionally contacting said concrete surface and supporting said frame means on said concrete surface, connected to the frame means so as to allow tilting of said rotor assemblies and operably connected to the power means, with each of said rotor assemblies comprising a plurality of troweling blade assemblies;

with said speed control system comprising:

a user input for generating a reference input signal for controlling rotation speed of said rotor assemblies;

a first speed feedback signal proportional to rotational speed of first said rotor assembly;

a second speed feedback signal proportional to rotational speed of second said rotor assembly;

computing means which comprises a first and second follower logic pattern;

the first follower logic pattern compares the reference input signal and first speed feedback signal of said first rotor assembly, and adjusts a first control signal to minimize the difference between the first speed feedback signal and reference input signal, with the first control signal changing the speed of rotation of first said rotor assembly; and the second follower logic pattern compares the first speed feedback signal and second speed feedback signal of said second rotor assembly, and adjusts a second control signal to minimize the difference between the second speed feedback signal and first speed feedback signal, with the second control signal changing the speed of rotation of second said rotor assembly.

17. The speed control system of claim 16 with a cruise control actuator that activates said cruise control logic pattern that keeps the reference input signal into the matching logic pattern at the same level as it is the moment the cruise control switch is activated.

18. The speed control system of claim 16 with power management logic pattern that takes a load feedback signal and scales the input signal to generate a scaled reference input signal into the matching logic pattern.

19. The speed control system of claim 16 in which said speed feedback signals are generated by blade speed sensors.

20. The speed control system of claim 16 in which said speed feedback signals are generated by RPM feedback units on the power transfer means of said rotor assemblies.

21. The speed control system of claim 16 in which the said feedback signals are generated by sensors measuring the displacement of the hydraulic pumps, with the first hydraulic pump operatively connecting the power means and the first rotor assembly and the second hydraulic pump operatively connecting the power means and the second rotor assembly.

22. The speed control system of claim 16 which further comprises two or more hydraulic pumps, each with controllable variable displacement, with each hydraulic pump having a control system with a transducer which generates a said speed feedback signal.

23. The speed control system of claim 1 in which the said speed feedback signals are generated by sensors measuring the displacement of the hydraulic motors which are operatively connected to said rotor assemblies, with the power means operatively connected to the hydraulic motors by one or more hydraulic pumps.

24. The speed control system of claim 1 which further comprises two or more variable displacement hydraulic motors operatively connected to said rotor assemblies with the power means operatively connected to the hydraulic motors by one or more hydraulic pumps; with each hydraulic motor having a control system with a transducer which generates a said speed feedback signal.

25. The speed control system of claim 9 in which the said first and second feedback signals are generated by sensors measuring the displacement of the first and second hydraulic motors which are operatively connected to said rotor assemblies, with the power means operatively connected to the hydraulic motors by one or more hydraulic pumps.

26. The speed control system of claim 9 which further comprises two or more variable displacement hydraulic motors operatively connected to said rotor assemblies with the power means operatively connected to the hydraulic motors by one or more hydraulic pumps; with the first hydraulic motor having a control system with a transducer which generates a said first speed feedback signal; with the second hydraulic motor having a control system with a transducer which generates a said second speed feedback signal.

27. The speed control system of claim 16 in which the said first and second feedback signals are generated by sensors measuring the displacement of the first and second hydraulic motors which are operatively connected to said rotor assemblies, with the power means operatively connected to the hydraulic motors by one or more hydraulic pumps.

28. The speed control system of claim 16 which further comprises two or more variable displacement hydraulic motors operatively connected to said rotor assemblies with the power means operatively connected to the hydraulic motors by one or more hydraulic pumps; with the first hydraulic motor having a control system with a transducer which generates a said first speed feedback signal; with the second hydraulic motor having a control system with a transducer which generates a said second speed feedback signal.

29. The power management logic pattern of claim 3 with said load feedback signal being a signal from engine relative to fuel delivery percentage.

30. The power management logic pattern of claim 3 with said load feedback signal being feedback from hydraulic system proportional to flow and pressure.

31. The power management logic pattern of claim 11 with said load feedback signal being a signal from engine relative to fuel delivery percentage.

32. The power management logic pattern claim 11 with said load feedback signal being feedback from hydraulic system proportional to flow and pressure.

33. The power management logic pattern of claim 18 with said load feedback signal being a signal from engine relative to fuel delivery percentage.

34. The power management logic pattern claim 18 with said load feedback signal being feedback from hydraulic system proportional to flow and pressure.

* * * * *